United States Patent [19]

Williams

[11] Patent Number: 4,519,787

[45] Date of Patent: May 28, 1985

[54] MECHANICAL TOY BULL

[76] Inventor: Lanny J. Williams, 1325 Peach Tree Ct., Frederick, Md. 21701

[21] Appl. No.: 418,025

[22] Filed: Sep. 14, 1982

[51] Int. Cl.[3] ..... A63H 11/00

[52] U.S. Cl. ..... 446/313; 272/52; 446/353; 446/385

[58] Field of Search ..... 46/127, 248, 130; 272/53.1, 53.2, 52.5, 52; 273/359, 366, 367; 446/313, 353, 385; 434/247

[56] References Cited

U.S. PATENT DOCUMENTS

| | | | |
|---|---|---|---|
| 1,671,162 | 5/1928 | Peters | 272/53.1 |
| 2,095,646 | 10/1937 | Lohr | 46/101 |
| 2,218,065 | 10/1940 | Berger | 46/127 |
| 2,801,104 | 7/1957 | Yetter | 272/53.1 |
| 2,988,847 | 6/1961 | Smith | 46/108 |
| 3,149,837 | 9/1964 | Kramm | 272/53.1 |
| 3,997,157 | 12/1976 | Meyer . | |
| 3,997,979 | 12/1976 | Turner | 35/29 R |
| 4,197,670 | 4/1980 | Cox | 46/DIG. 1 X |

*Primary Examiner*—F. Barry Shay
*Attorney, Agent, or Firm*—William H. Wright

[57] ABSTRACT

A toy mechanical bull having rotary and reciprocal movements used in conjunction with a doll figure having releasable securing means adapted for cooperation with complementary releasable securing means on the toy mechanical bull, wherein the rotary and reciprocal movements of the toy mechanical bull will disengage the releasable securing means resulting in a simulation of a mechanical bull throwing a rider from its back.

17 Claims, 5 Drawing Figures

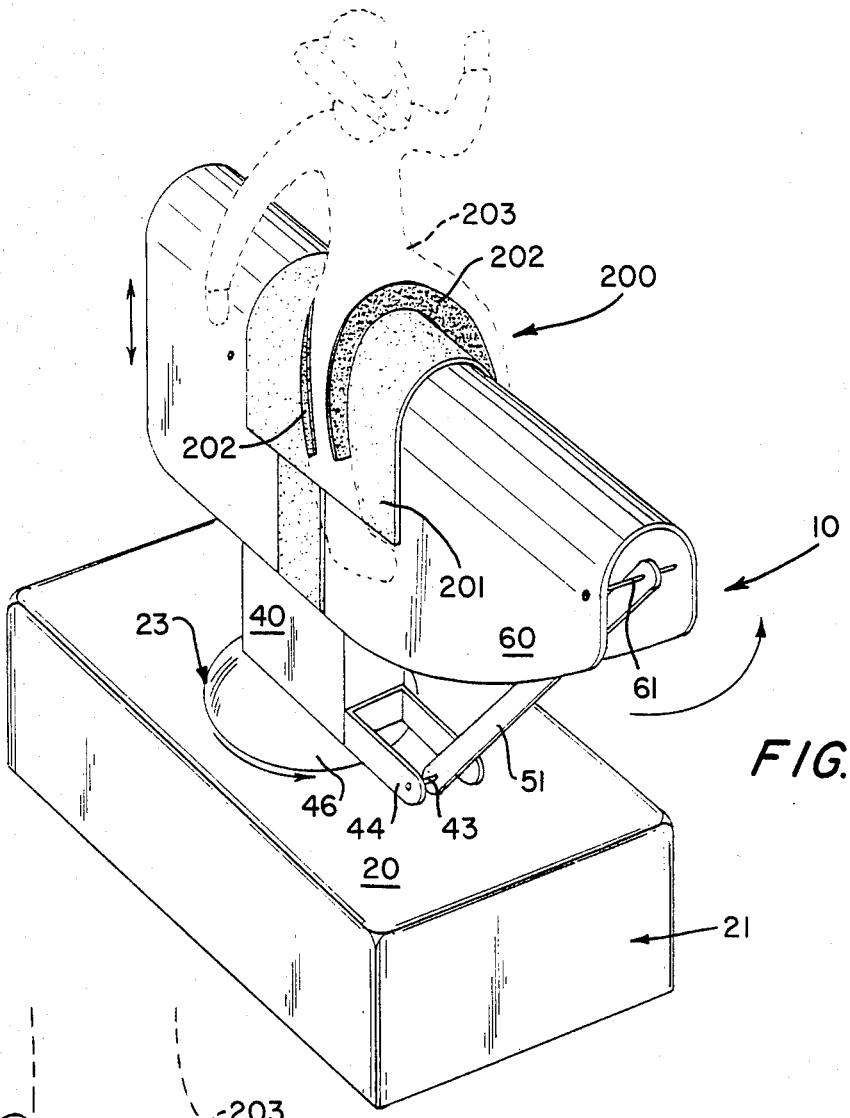
FIG. 1
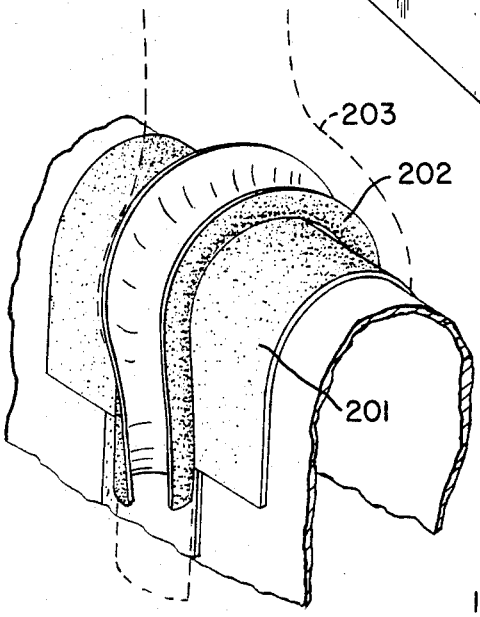
FIG. 3
FIG. 2
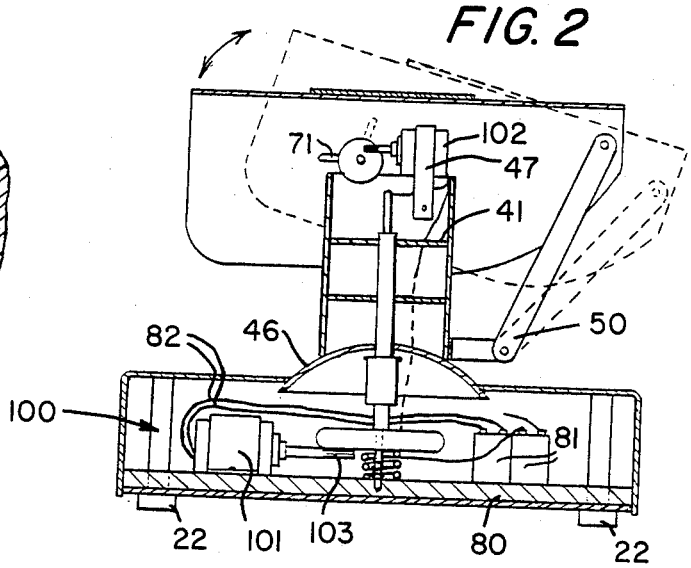

MECHANICAL TOY BULL

BACKGROUND OF THE INVENTION

While the prior are is replete with toy or mechanical animal devices, as can be seen by reference to U.S. Pat. Nos. 2,095,646; 2,218,065; 2,801,104; 2,988,847 and 3,997,157; these devices fall far short of duplicating the motions of the "mechanical bull", that was prominently featured in the movie "Urban Cowboy".

The actual rodeo training device that was depicted in the movie, formed the subject matter of U.S. Pat. No. 3,997,979, and this device has subsequently enjoyed its own commercial success, and as a result of popular demand, can be found in numerous night spots throughout the country.

The mechanical motions, that distinguish the actual device from the prior art toys, are the combination of rotary and reciprocal movements, on a continuous and/or sequential basis.

All of the prior art toy mechanical animals seem to have either a solely vertical reciprocal motion or a solely rotary motion. Neither of these motions alone produces a visual effect, which even remotely resembles the actual rodeo training device, upon which the present invention is based.

Due to the widespread popularity enjoyed by the mechanical bull, it is surprising that to date no one has been able to develop a toy, which closely simulates the movements of the actual device.

As a result of the foregoing, the device which forms the basis of the present invention was developed, and the end result is a toy mechanical bull which closely approximates the combined rotary and reciprocal movements employed in the actual device.

SUMMARY OF THE INVENTION

An object of the present invention is the provision of a toy mechanical bull, whose movements closely approximate the movements of an actual rodeo training device.

Another object of the present invention is to provide simplified actuating mechanisms, that will produce vertical and reciprocal movements in a toy, to simulate the movements of a mechanical bull.

Still another object of the present invention is to provide a toy mechanical bull, that can be used in conjunction with a doll figure, to reproduce the actual results produced by a living or mechanical bull, when ridden by a human rider.

Yet another object of the present invention is to provide means on a toy mechanical bull, that will cooperate with means adapted to be secured to a doll figure, to releasably secure the doll figure on the toy mechanical bull.

A further object of the present invention is the provision of a toy mechanical animal that produces simultaneous rotary and reciprocal movements.

These and other objects, advantages, and novel features of the invention will become apparent from the detailed description which follows when viewed in conjunction with the accompanying drawings.

BRIEF DESCRIPTION OF THE DRAWINGS

FIG. 1, is a perspective view of the toy mechanical bull used conjunction with a doll figure.

FIG. 2, is a cross-sectional view showing the internal mechanisms of the toy mechanical bull.

FIG. 3, is a detail view showing the cooperation releasable securing means on the toy mechanical bull and the doll figure used in conjunction therewith.

DETAILED DESCRIPTION OF THE PREFERRED EMBODIMENT

Figure 4:
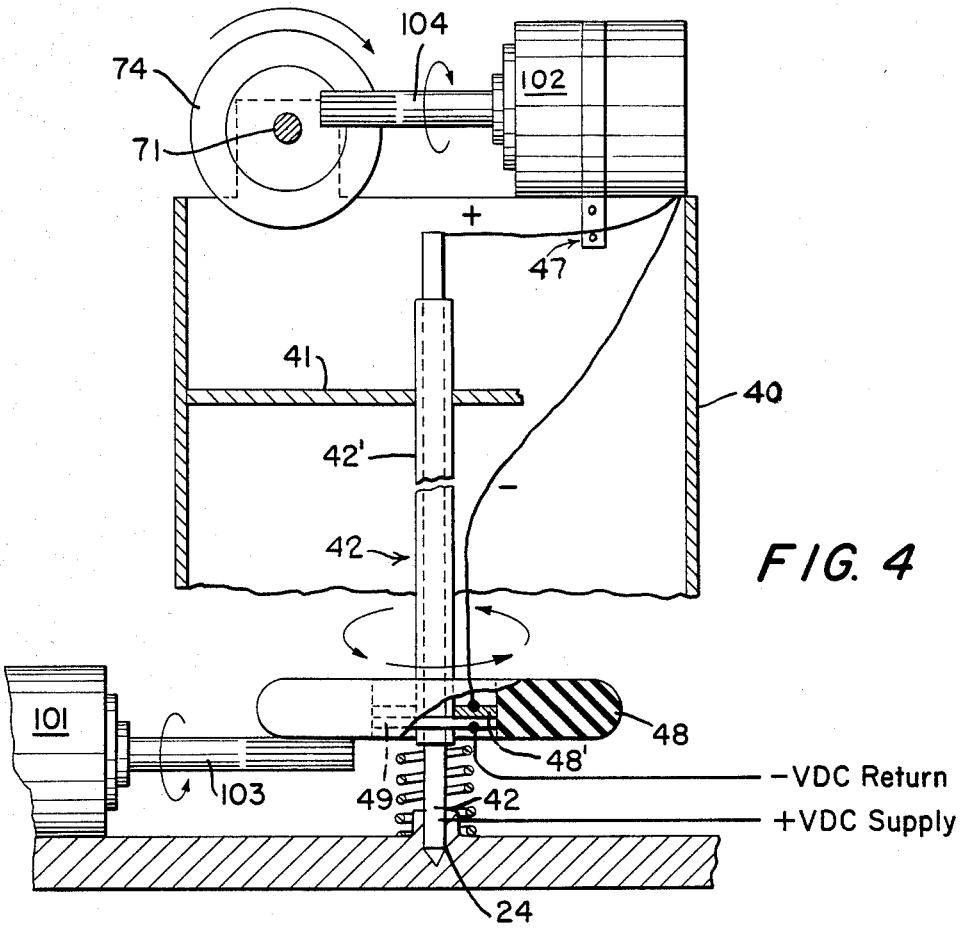
FIG. 4, is a detail view of the power supply connection to the upper actuating motor employed in the device.

As can be seen by reference to FIG. 1, the toy mechanical bull, which forms the basis of the present invention, is designated generally as 10. The toy mechanical bull, hereinafter referred to as the device 10, further comprises a housing 20, a vertical support column 40, and a simulated miniature animal body 60, operatively connected to one another.

The housing 20, forms a base for the device 10, and in the preferred embodiment, is in the form of an elongated rectangular enclosure 21, which may be fabricated from either metal, plastic, or other suitable rigid materials. The enclosure 21, is further provided with a plurality of support legs 22, on its lower surface. In addition, the enclosure 21, further provides a housing for the power supply 80, and at least a portion of the actuating mechanism 100.

Referring now to FIG. 2, it can be seen that the power supply 80, in the preferred embodiment, comprises a pair of 9 v batteries 81, with the appropriate electrical leads 82, connected thereto. It should be appreciated at this juncture, that this invention also contemplates the use of an external source of electrical current to power the device 10, and should not be limited to the battery operated operation illustrated and described.

Figure 5:
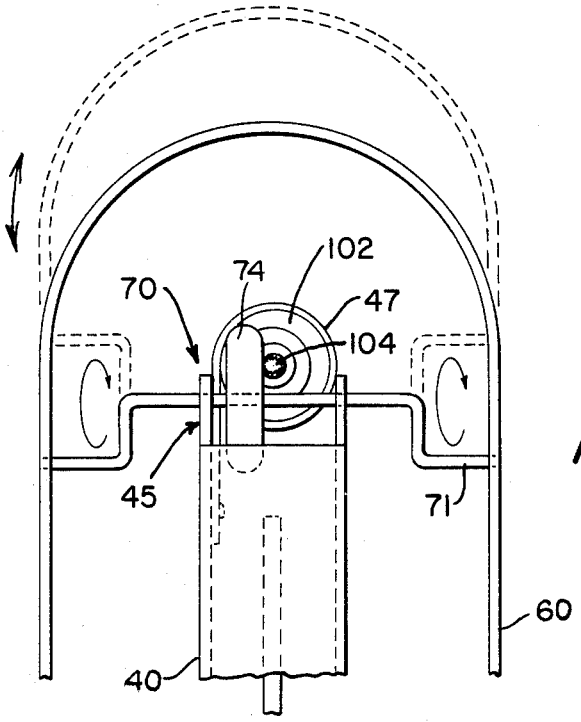
FIG. 5, is a detail view of the vertical reciprocal actuator mechanism.

Turning now to the operative connection between the housing 20, the support column 40, and the miniature animal body 60; it can be seen that the vertical support housing 40, is provided with apertured insulated internal partitions 41, which frictionally engage an insulated jacket 42' which is disposed about an electrically conductive elongated rod member 42. The lower end of the rod member 42, is received in a suitably dimensioned aperture 24, in the floor of the enclosure 21; and the remainder of the rod 42, projects through the central aperture 23, in the base 20, and a substantial vertical distance into the support column 40. The miniature animal body is in turn connected to the vertical support column 40, by virture of the linkages 50, and 70, depicted in FIGS. 2 and 5.

Linkage 50, comprises an elongated lever arm 51, which is pivotally connected on one end to a pivot rod 43, secured between the free ends of a U-shaped horizontal bracket 44, disposed on the lower portion of the vertical support column 40. The other end of the lever arm 51, is likewise pivotally secured to a pivot rod 61, disposed in the forward portion of the miniature animal body 60.

The linkage 70, on the other hand, comprises an elongated contoured crank lever 71, supported by a pair of vertically projecting ear members 45, formed on the upper surface of the vertical support column 40. The ends of the crank lever 71, extend into either side of the miniature animal body 60, proximate its midpoint, and are rotatably disposed therein.

The vertical support column 40, is further provided with an insulated curved skirt member 46, on its lower end, and a motor support bracket 47, on its upper end. The skirt member 46, serves the dual function of insulating the vertical support column 40, from the base 20, and also providing an aesthetically pleasing appearance to the device, as the base and column rotate with respect to one another. The motor support bracket 47, is provided to support one of the actuating motors, that forms part of the actuating mechanism 100, that will now be described in detail.

The actuating mechanism 100, comprises a pair of small electric motors 101 and 102, connected to the power supply 80. The motor 101, imparts the rotary movement, and the motor 102, imparts the vertical reciprocal movement, to the device 10.

Motor 101, is mounted on the floor of the enclosure 21, and is provided with an output shaft 103, which cooperates with a first pinion wheel 48, rotatably secured to the elongated rod member 42. As the output shaft 103, rotates, it will impart a rotary motion to the pinion wheel 48, via frictional engagement therewith. This rotary motion is in turn imparted to the vertical support column 40.

Motor 102, is also provide with an output shaft 104, which cooperated with a second pinion wheel 74, rigidly secured to the crank arm 71. As the output shaft 104, rotates, it will impart a rotary motion to the pinion wheel 74, via frictional engagement therewith. This rotary motion will have a vertical reciprocal component, which will be imparted to the miniature animal body, by virtue of the linkage assemblied 50 and 70, to produce the simulated "bucking" action of the device.

As shown in FIG. 2, a pair of standard electrical leads 82, forms the electrical connection between the power source 80, and motor 101. The electrical connection between the power source 80, and motor 102, presents some unusual problems due to the relative rotation between the miniature animal body 60, and the base member 20.

As can best be seen by reference to FIG. 4, the conductive rod member 42, is provided with an insulated jacket 42', extending along most of its length, which leaves both ends of the rod exposed. The first pinion wheel 48, is further provided with an electrically conductive hub (48'), which is insulated from the conductive rod member 42, via the jacket 42', and which frictionally engages a spring biased conductive washer 49.

In order to connect the positive and negative terminals of the power source 80, to the appropriate terminals on the motor 102, brush contacts must be established between the relatively rotating components. To accomplish this task the electrical lead from the positive terminal of the battery is in contact with the exposed lower end of the conductive rod member 42, and the electrical lead from the negative terminal of the motor 102, is in brushing contact with the upper surface of the conductive hub 48'. The electrical lead to the negative terminal of the battery is likewise in contact with the underside of the conductive washer 49, to complete the electrical circuit.

In addition, to the aforementioned features, the miniature animal body 60, is further provided with releasable securing means 200. These releasable securing means 200, are fabricated from Velcro, and comprise a "hard" Velcro securing means 201, in the form of a saddle, rigidly secured to the miniature animal body, and a "soft" Velcro securing means, in the form of chaps, which are adapted to be secured to the lower torso of a doll figure 203 (shown in phantom), to releasably secure the doll figure to saddle portion 201, of the miniature animal body.

One of the unexpected benefits derived from the use of Velcro fasteners is that, as opposed to other releasable fastening means, the Velcro fasteners allow the doll figure to pitch back and forth on the miniature animal body, in much the same manner as a person would react, to the movements of a live or mechanical animal. This result is produced by the disengagement and reengagement of different portions of the chaps 202, with different portions of the saddle 201, as a result of the motions of the miniature animal body 60, in several planes.

It should also be particularly noted, that no other releasable fastening means produces quite the same effect, and the employment of Velcro features is considered to be crucial to this invention.

The ultimate result produced, by the motions of the device 10, with regard to the doll figure 203, is that the releasable securing means will eventually totally disengage, and the doll figure 203, will be "bucked" or "thrown" from the miniature mechanical animal. This visual effect will not only be enjoyable for children but will also produce fond memories for adults whom have ridden a living animal or a mechanical simulation thereof.

Having thereby disclosed the subject matter of this invention, it should be obvious that many substitutions, modifications and variations are possible in light of the above teachings. It is therefore to be understood that the invention as taught and described, is only to be limited to the extent of the breadth and scope of the appended claims.

What I claim is:

1. A toy mechanical animal designed to simulate the actions of a full size rodeo training device, commonly referred to as a "mechanical bull" wherein the toy comprises a base member a vertical support column rotatably disposed on an elongated vertically disposed conductive rod which is received within the base member;

a miniature animal body moveably attached to the vertical support column; and motor means associated with the toy to impart rotary motion to the miniature animal body in the horizontal and vertical planes wherein the motor means comprises, a first motor mounted in the base member, and operatively connected to the vertical support column, and a second motor mounted on top of the vertical support column, and operatively connected to the miniature animal body, wherein the first and second motors are powered by electricity, and the vertically disposed conductive rod is provided with an electrically insulated jacket that leaves only the areas adjacent the ends of the tubular rod exposed, and the vertical support column is provided with a plurality of electrically insulated partitions, which engage the insulated jacket on the conductive rod.

2. A toy as in claim 1, wherein, the conductive rod forms part of an electrical circuit between a source of electricity and the said second motor.

3. A toy as in claim 2; wherein, the top of the vertical support column is provided with a pair of projecting ears, which rotatably support a crank lever, which is further connected on either end to the miniature animal body proximate its midpoint, and a pivoted lever arm is operatively connected between the vertical support column and the forward end of the miniature animal body.

4. A toy as in claim 3; further comprising a first pinnion wheel, having an electrically conductive hub secured to said insulated jacket, wherein the rim of said first pinnion wheel is disposed in frictional engagement with the output shaft of said first motor, and a second pinnion wheel rigidly secured to the crank lever, and disposed in frictional engagement with the output shaft of said second motor.

5. A toy as in claim 4; further comprising, a spring-biased electrically conductive washer mounted in the base member, and disposed in contact with the electrically conductive hub of the first pinnion wheel.

6. A toy as in claim 5; wherein, the electrical connection between the source of electricity and the second motor comprises;

a first electrical lead from the positive terminal of the source of electricity to one exposed end of the conductive rod, wherein the first lead is in contact with the one exposed end of the conductive rod;

a second electrical lead from the positive terminal of the second motor to the other end of the conductive rod, wherein the second lead is in brushing contact with the other end of the rod;

a third electrical lead from the negative terminal of the source of electricity to the underside of the conductive washer; and a fourth electrical lead from the negative terminal of the second motor to the top surface of the conductive hub.

7. A toy as in claim 6; wherein the electrical connection between the source of electricity and the first motor comprises;

a fifth flead from the negative terminal of the source of electricity to the negative terminal of the first motor; and a sixth electrical lead from the positive terminal of the source of electricity to the positive terminal of the first motor.

8. A toy mechanical animal in combination with a doll figure; wherein, the toy comprises:

a base member a vertical support column rotatably mounted with respect to said base member disposed on an elongated vertically disposed conductive rod which is received within the base member a miniature animal body movably attached to the vertical support column;

motor means associated with the toy to impart rotary motion to the miniature animal body in the horizontal and vertical planes;

hard Velcro fastening means configured in the form of a saddle and secured to the outer surface of the miniature animal body; and soft Velcro fastening means configured in the form of chaps, and adapted to be secured to the lower torso of the doll figure, to releasably secure the doll figure to the toy mechanical animal body whereby the rotation of the miniature animal body in the horizontal and vertical planes will cause the doll figure and the simulated chaps to assume a variety of positions with respect to the simulated saddle, that will ultimately produce the eventual disengagement of the doll figure and the simulated chaps from the miniature animal body.

9. A toy as in claim 8; wherein the motor means comprises, a first motor mounted in the base member, and operatively connected to the vertical support column, and a second motor mounted on top of the vertical support column, and operatively connected to the miniature animal body.

10. A toy as in claim 9; wherein the first and second motors are powered by electricity, and the vertically disposed rod is fabricated from an electrically conductive material.

11. A toy as in claim 10; wherein, the rod is provided with an electrically insulated jacket that leaves only the areas adjacent the ends of the rod exposed, and the vertical support column is provided with a plurality of electrically insultated partitions, which frictionally engage the insulated jacket on the rod.

12. A toy as in claim 11; wherein, the rod forms part of an electrical circuit between a source of electricity and the said second motor.

13. A toy as in claim 12; wherein, the top of the vertical support column is provided with a pair of projecting ears, which rotatably support a crank lever which is further connected on either end to the miniature animal body proximate its midpoint, and a pivoted lever arm is operatively connected between the vertical support column and the forward end of the miniature animal body.

14. A toy as in claim 13; further comprising, a first pinnion wheel having an electrically conductive hub, secured to said insulated jacket on the vertical rod, and disposed in frictional engagement with the output shaft of said first motor, and a second pinnion wheel rigidly secured to the crank lever, and disposed in frictional engagement with the output shaft of said second motor.

15. A toy as in claim 14; further comprising, a spring biased electrically conductive washer mounted in the base member, and disposed in contact with the electrically conductive hub of the first pinnion wheel.

16. A toy as in claim 15; wherein, the electrical connection between the source of electricity and the second motor comprises;

a first electrical lead from the positive terminal of the source of electricity to one exposed end of the conductive rod, wherein the first lead is in contact with the one exposed end of the rod;

a second electrical lead from the positive terminal of the second motor to the other end of the conductive rod, wherein the second lead is in contact with the other end of the rod;

a third electrical lead from the negative terminal of the source of electricity to the underside of the conductive washer; and a fourth electrical lead from the negative terminal of the second motor to the top surface of the conductive hub.

17. A toy as in claim 16; wherein the electrical connection between the source of electricity and the first motor comprise;

a fifth electrical lead from the negative terminal of the source of electricity to the negative terminal of the first motor; and a sixth electrical lead from the positive terminal of the source of electricity to the positive terminal of the first motor.

* * * * *